US006311655B1

(12) United States Patent
Simpson et al.

(10) Patent No.: US 6,311,655 B1
(45) Date of Patent: Nov. 6, 2001

(54) MULTI-POSITION VARIABLE CAM TIMING SYSTEM HAVING A VANE-MOUNTED LOCKING-PISTON DEVICE

(75) Inventors: Roger T. Simpson, Ithaca; Michael Duffield, Willseyville; Marty Gardner, Ithaca, all of NY (US)

(73) Assignee: BorgWarner Inc., Troy, MI (US)

( * ) Notice: Subject to any disclaimer, the term of this patent is extended or adjusted under 35 U.S.C. 154(b) by 0 days.

(21) Appl. No.: 09/488,903

(22) Filed: Jan. 21, 2000

(51) Int. Cl.[7] ..... F01L 1/344
(52) U.S. Cl. ..... 123/90.17; 74/568 R
(58) Field of Search ..... 123/90.15, 90.17, 123/90.31; 74/568 R

(56) References Cited

U.S. PATENT DOCUMENTS

| | | | | |
|---|---|---|---|---|
| 2,861,557 | | 11/1958 | Stolte . | |
| 4,858,572 | | 8/1989 | Shiraii et al. . | |
| 5,507,254 | * | 4/1996 | Melchoir | 123/90.17 |
| 5,797,361 | | 8/1998 | Mikame et al. . | |
| 5,816,204 | * | 10/1998 | Moriya et al. | 123/90.17 |
| 5,836,275 | | 11/1998 | Sato . | |
| 5,924,395 | * | 7/1999 | Moriya et al. | 123/90.15 |
| 5,979,380 | * | 11/1999 | Nakadouzono et al. | 123/90.17 |
| 6,053,138 | * | 4/2000 | Trzmiel et al. | 123/90.17 |
| 6,085,708 | | 7/2000 | Trzmiel et al. | 123/90.17 |
| 6,105,543 | | 8/2000 | Ogawa | 123/90.17 |
| 6,129,063 | | 10/2000 | Niethammer et al. | 123/90.17 |

FOREIGN PATENT DOCUMENTS 0 924 392 A2 6/1999 (EP) .

* cited by examiner

*Primary Examiner*—Weilun Lo
(74) *Attorney, Agent, or Firm*—Emch, Schaffer, Schaub & Porcello Co., L.P.A.; Greg Dziegielewski

(57) ABSTRACT

An internal combustion engine having a camshaft (14) and variable camshaft timing system, where a rotor (22) is secured to the camshaft (14) and is rotatable but non-oscillatable with respect to the camshaft (14). A housing (68) circumscribes the rotor (22), is rotatable with both the rotor (22) and the camshaft (14), and is further oscillatable with respect to both the rotor (22) and the camshaft (14) between a fully retarded position and a fully advanced position. A locking configuration prevents relative motion between the rotor and the housing (68), and is mounted within either the rotor (22) or the housing (68), and is respectively and releasably engageable with the other of either the rotor (22) and the housing (68) in the fully retarded position, the fully advanced position, and in positions therebetween. The locking device includes a locking piston (42) having keys (46) terminating one end (44) thereof, and serrations (60) mounted opposite the keys (46) on the locking piston (42) for interlocking the rotor (22) to the housing (68). A controlling configuration controls oscillation of the rotor (22) relative to the housing (68).

19 Claims, 10 Drawing Sheets

MULTI-POSITION VARIABLE CAM TIMING SYSTEM HAVING A VANE-MOUNTED LOCKING-PISTON DEVICE

CROSS-REFERENCES

The present application is related to provisional patent application No. 60/173330, which was filed on Dec. 28, 1999, and is related to pending application Ser. No. 09/450,456 filed Nov. 29, 1999, and entitled "Variable Valve Timing with Actuator Locking for Internal Combustion Engine", by inventor Roger T. Simpson. Additionally, the present application is related to copending application Ser. No. 09/473,804, filed on Dec. 28, 1999, and entitled "Multi-Position Variable Cam Timing System Actuated by Engine Oil Pressure", by inventors Roger T. Simpson, Michael C. Duffield, and Marty Gardner, and thus is incorporated by reference herein. Finally, the present application is related to copending application Ser. No. 09/592,624 also filed on Dec. 28, 1999, and entitled "Control Valve Strategy for Vane-Type Variable Camshaft Timing System", by inventors Roger T. Simpson and Frank R. Smith, and thus is also incorporated by reference herein.

BACKGROUND OF THE INVENTION

1. Field of the Invention

The present invention generally relates to an internal combustion engine having a hydraulic control system for controlling the operation of a variable camshaft timing (VCT) system of the type in which the camshaft position is circumferentially varied relative to the position of a crankshaft in reaction to oil pressure. In such a VCT system, an electro-hydraulic control system is provided to effect the repositioning of the camshaft and a locking system is provided to selectively permit or prevent the electro-hydraulic control system from effecting such repositioning.

More specifically, this invention relates to a multi-position VCT system actuated by engine oil pressure and having a locking piston mounted to a rotor, wherein the locking piston prevents oscillation of the rotor in an advance position, a retard position, and multitude of positions therebetween.

2. Description of the Prior Art

It is known that the performance of an internal combustion engine can be improved by the use of dual camshafts, one to operate the intake valves of the various cylinders of the engine and the other to operate the exhaust valves. Typically, one of such camshafts is driven by the crankshaft of the engine, through a sprocket and chain drive or a belt drive, and the other of such camshafts is driven by the first, through a second sprocket and chain drive or a second belt drive. Alternatively, both of the camshafts can be driven by a single crankshaft-powered chain drive or belt drive. It is also known that the performance of an internal combustion engine having dual camshafts, or but a single camshaft, can be improved by changing the positional relationship of a camshaft relative to the crankshaft.

It is also known that engine performance in an engine having one or more camshafts can be improved, specifically in terms of idle quality, fuel economy, reduced emissions, or increased torque, by way of a VCT system. For example, the camshaft can be "retarded" for delayed closing of intake valves at idle for stability purposes and at high engine speed for enhanced output. Likewise, the camshaft can be "advanced" for premature closing of intake valves during mid-range operation to achieve higher volumetric efficiency with correspondingly higher levels of torque. In a dual-camshaft engine, retarding or advancing the camshaft is accomplished by changing the positional relationship of one of the camshafts, usually the camshaft that operates the intake valves of the engine, relative to the other camshaft and the crankshaft. Accordingly, retarding or advancing the camshaft varies the timing of the engine in terms of the operation of the intake valves relative to the exhaust valves, or in terms of the operation of the valves relative to the position of the crankshaft.

Heretofore, many VCT systems incorporating hydraulics included an oscillatable rotor secured to a camshaft within an enclosed housing, where a chamber is defined between the rotor and housing. The rotor includes vanes mounted outwardly therefrom to divide the chamber into separated first and second fluid chambers. Such a VCT system often includes a fluid supplying configuration to transfer fluid within the housing from one side of a vane to the other, or vice versa, to thereby oscillate the rotor with respect to the housing in one direction or the other. Such oscillation is effective to advance or retard the position of the camshaft relative to the crankshaft. These VCT systems may either be "self-powered" having a hydraulic system actuated in response to torque pulses flowing through the camshaft, or may be powered directly from oil pressure from an oil pump. Additionally, mechanical connecting devices are included to lock the rotor and housing in either a fully advanced or fully retarded position relative to one another.

Unfortunately, the above VCT systems may have several drawbacks. For example, U.S. Pat. No. 4,858,572 to Shirai et al., teaches use of spring-loaded locking pistons in two circumferential positions to lock the rotor and housing in both a fully advanced and a fully retarded position. Shirai et al. discloses a first pin extending into a radial bore of the housing. The pin is urged radially inwardly toward the rotor by a spring mounted between the pin and the bore. When the VCT is in the fully retarded position, an upper end of the pin fits into a large radius portion of a radial hole in the rotor. If the VCT is changed to the advanced condition, the first pin is retracted from the radial hole by fluid pressure overcoming the spring. Another pin positioned opposite the first pin similarly locks the rotor in the fully advanced position. Thus, the rotor is prevented from rotary movement relative to the housing.

One drawback with Shirai et al. is that the pins act to lock the rotor relative to the housing in only two circumferential positions, either fully advanced or fully retarded. Another drawback is that the pins may stick in either the fully advanced or fully retarded position thus jamming the VCT. When the VCT changes from one position to another, part of the fluid pressure being transferred to the first and second fluid chambers gets redirected to one of the pins to retract the pin. Accordingly, the fluid pressure is applied simultaneously to the fluid chambers and the pin. When the fluid pressure in the fluid chambers is sufficient to start rotating the rotor before the pin is fully retracted, the rotor side loads the pin causing the pin to stick in the radial hole and thus renders the VCT inoperative.

U.S. Pat. No. 5,836,275 to Sato recognized the above-mentioned problem with Shirai et al. and attempted a solution. Sato teaches use of hydraulic strategy to retract the pin before charging either the first or second fluid chambers. Accordingly, Sato discloses fluid pressure supplied to the radial hole in the rotor while simultaneously charging fluid passages communicating with either the first or second fluid chambers. Because the fluid passages are initially restricted, and thus only partially in communication with the first or second fluid chambers, the fluid pressure acts primarily on the pin to retract the pin before any appreciable rotation of the rotor occurs. After the pin retracts, the rotor rotates enough to permit the passages to overcome their restriction and fully communicate with the fluid chambers to effect rotation of the rotor. Regrettably, however, the Sato invention permits locking of the rotor in only the fully retarded position.

U.S. Pat. No. 5,797,361 to Mikame et al. recognized another problem with Shirai et al. That is, in the retracted position, the upper end of the pin loads an external surface of the rotor due to the spring force pushing the pin toward the rotor. This wears the rotor's circumference creating grooves that facilitate increased leakage between the housing and the rotor beyond an acceptable level. The leakage lowers the oil pressure in the chamber and thus deteriorates the responsiveness of the VCT. In addition, the wear condition hinders smooth relative rotation between the rotor and housing. Finally, Mikame et al. submits that maintaining fluid pressure in the Shirai et al. invention at a certain level is difficult, since Shirai et al. relies on fluid pressure caused by torque fluctuations in the camshaft. Unfortunately, Mikame et al. suffers from the same drawback as Sato. That is, the locking piston locks the rotor relative to the housing in only one circumferential position. Finally, the locking piston of Mikame et al. and the hole with which it interlocks have clearance therebetween that permits circumferential free play or slack between the housing and the rotor. This slack condition could lead to noise at engine startup as the locking piston is knocked about within the hole.

Accordingly, all of the above mentioned prior art references incorporate a locking piston mounted within a housing and lockable with a rotor in only one position per locking piston. For example, the Shirai et al. reference is lockable in only a fully advanced or fully retarded position using two locking pistons. Furthermore, each locking piston interlocks with the rotor in diametral engagement, which may lead to sticking conditions of the VCT, as discussed in Sato.

Therefore, what is needed is a VCT system that is designed to overcome the problems associated with prior art variable camshaft timing arrangements using locking pistons, by providing a variable camshaft timing system that locks a rotor and housing together in more than one position per locking piston, is not susceptible to unintended lock-up conditions created by diametral jam conditions between the locking piston and a locking piston hole, and does not permit rotational slack between the rotor and housing.

SUMMARY OF THE INVENTION

According to the present invention there is provided a VCT system that is designed to overcome the problems associated with prior art variable camshaft timing arrangements using locking pistons, by providing a variable camshaft timing system that locks a rotor and housing together in more than one position per locking piston, is not susceptible to unintended lock-up conditions created by diametral jam conditions between the locking piston and a locking piston hole, and does not permit rotational slack between the rotor and the housing.

In one form of the invention, there is included an internal combustion engine having a camshaft. A rotor is secured to the camshaft and is rotatable with the camshaft, but non-oscillatable with respect to the camshaft. A housing circumscribes the rotor, is rotatable with both the rotor and the camshaft, and is further oscillatable with respect to both the rotor and the camshaft between a fully retarded position and a fully advanced position. A locking device is also provided for preventing relative motion between the rotor and the housing. The locking device is mounted within either the rotor or the housing and is respectively and releasably engageable with the other of either the rotor and the housing in the fully retarded position, the fully advanced position, and in at least one and preferably a plurality of intermediate positions therebetween. The locking device includes a locking piston having keys terminating one end thereof, and a serrations mounted opposite the keys on the piston for interlocking the rotor to the housing. Finally, a controlling device for controlling oscillation of the rotor relative to the housing is provided.

Accordingly, it is an object of the present invention to provide a VCT system that obviates or mitigates at least one of the above-mentioned problems of the prior art.

It is another object to provide a VCT system that is capable of interlocking a rotor to a housing in not only one or two positions, but in a fully advanced position, a fully retarded position, and in at least one and preferably a plurality of intermediate positions therebetween.

It is yet another object to provide a VCT system that has a locking piston that has interlocking features terminating one end of the piston, that interlock with other interlocking features mounted to a component that interlocks with the locking piston, such that the rotor and housing lock tightly together without slack therebetween and such that the piston does not jam or become locked up.

These objects and other features, aspects, and advantages of this invention will be more apparent after a reading of the following detailed description, appended claims, and accompanying drawings.

DETAILED DESCRIPTION OF THE PREFERRED EMBODIMENT

In general, a hydraulic timing system is provided for varying the phase of one rotary member relative to another rotary member. More particularly, the present invention provides a multi-position Variable Camshaft Timing (VCT) system powered by engine oil pressure for varying the timing of a camshaft of an engine relative to a crankshaft of an engine to improve one or more operating characteristics of the engine. While the present invention will be described in detail with respect to internal combustion engines, the VCT system is also well suited to other environments using hydraulic timing devices. Accordingly, the present invention is not limited to only internal combustion engines.

Figure 2:
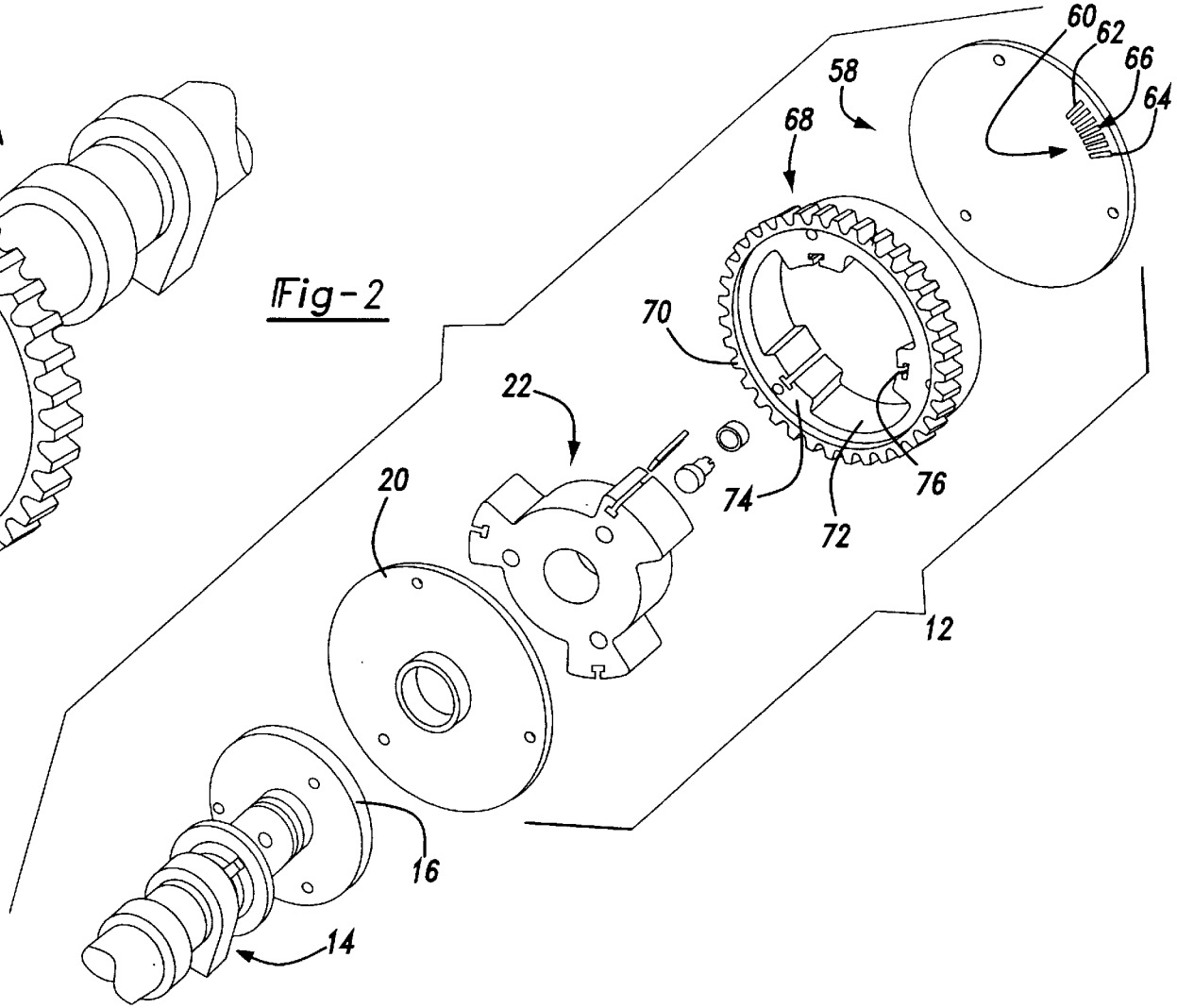
FIG. 2 is an exploded perspective view of the camshaft and vane phaser according to the preferred embodiment of the present invention.
Figure 1:
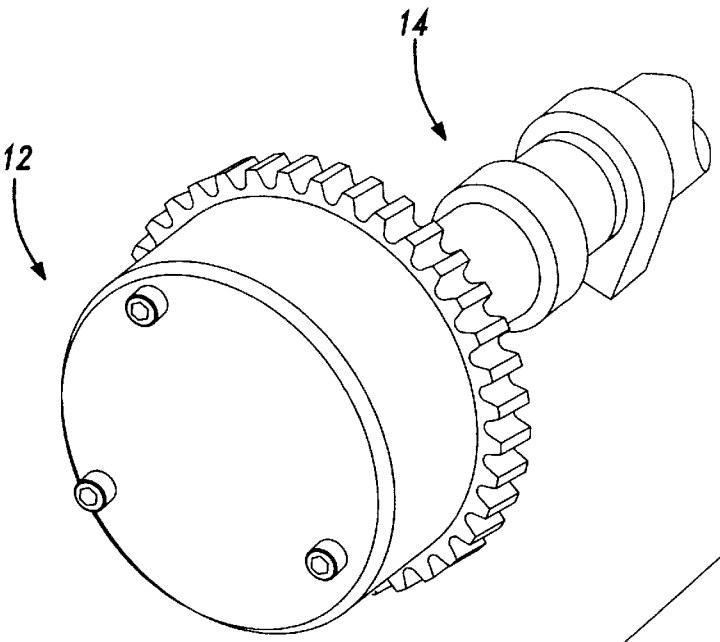
FIG. 1 is a perspective view of a camshaft and vane phaser according to the present invention.

Referring now in detail to the Figures, there is shown in FIGS. 1 and 2 a vane phaser 12 and camshaft 14 according to the preferred embodiment of the present invention. As shown in FIG. 2, the camshaft 14 has a flange 16 at one end. A flange plate 20 of the vane phaser 12 mounts to the flange 16 and acts as an axial locator for a rotor 22. A housing 68 circumscribes the rotor 22, and the rotor 22 and housing 68 are sandwiched against the flange plate 20 by a locking plate 58. Three bolts (not shown) fasten the rotor 22 to the flange 16 of the camshaft 14 so that the rotor 22 is rotatable with the camshaft 14. Similarly, three other bolts (not shown) fasten the locking plate 58 to the flange plate 20, thereby securing the housing 68 therebetween. Accordingly, both the rotor 22 and the housing 68 are rotatable with the camshaft 14 and the rotor 22 and the housing 68 are oscillatable independently of one another.

Figure 3:
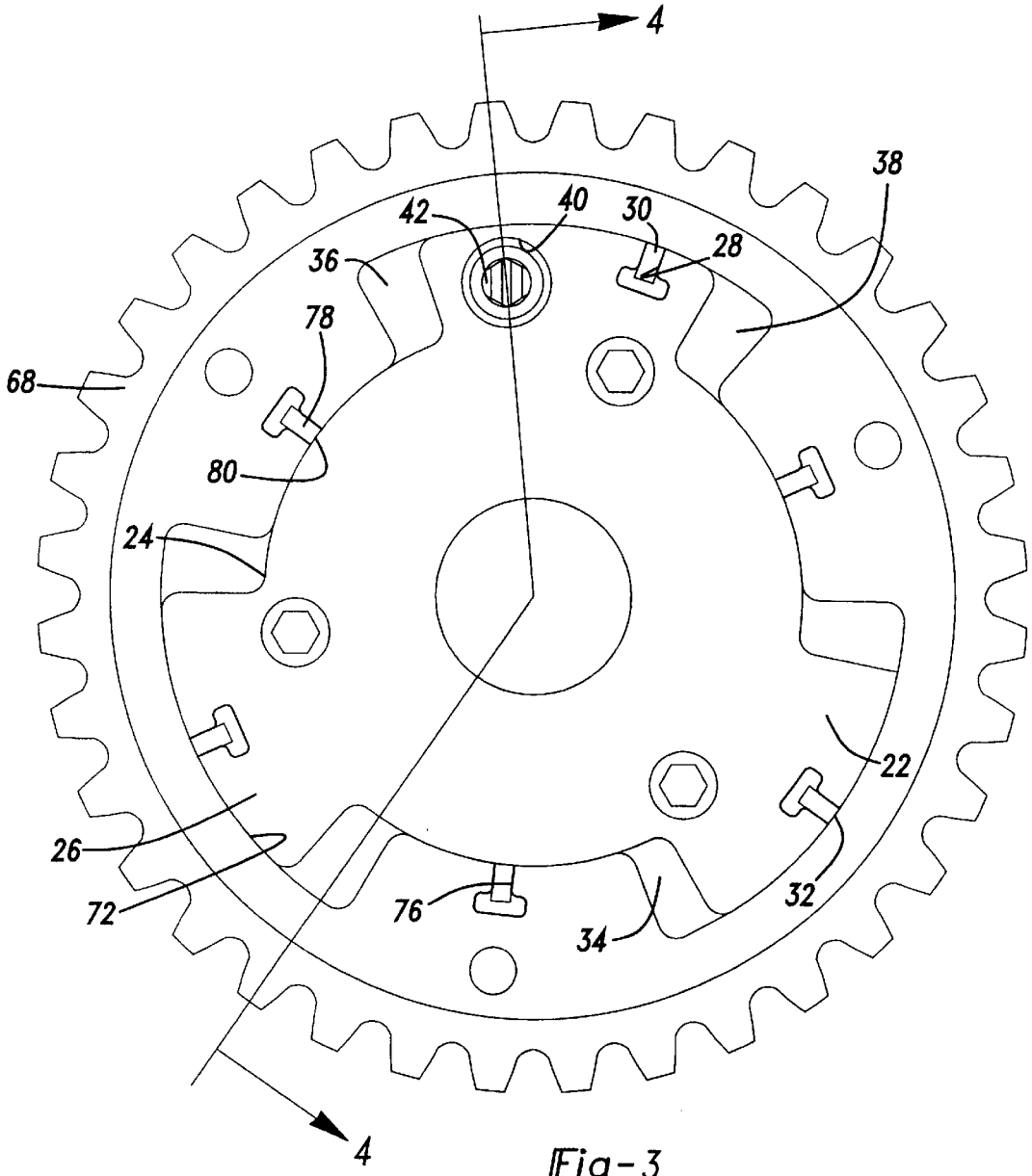
FIG. 3 is an right end view of the vane phaser of FIG. 2 without the locking plate.

Still referring to FIG. 2, the locking plate 58 includes an array of female interlocking features or serrations 60 therein. The array of female serrations 60 includes a retard serration 62, an advance serration 64, and a multitude of intermediate serrations 66 therebetween. The housing 68 includes sprocket teeth 70 disposed about its periphery and includes an internal surface 72 and radially inwardly extending lobes 74 circumferentially spaced apart with an outwardly extending radial slot 76 in each lobe 74. Each radial slot 76 is open to the internal surface 72 and extends radially outwardly therefrom. As shown in FIG. 3, the housing 68 includes a driving vane 78 that is radially and slidably disposed in each radial slot 76. Each driving vane 78 has an inner edge 80 that engages an external surface 24 of the rotor 22. Each driving vane 78 may be spring-loaded by a bias member (not shown) radially inwardly to ensure constant contact with the external surface 24 of the rotor 22.

Still referring to FIG. 3, the rotor 22 includes radially outwardly extending lobes 26 circumferentially spaced apart, around the external surface 24. One lobe 26 includes a piston passage 40 for housing a generally T-shaped axial locking piston 42 therein. Each lobe 26 also includes an inwardly extending radial slot 28 disposed therein.

The rotor 22 further includes a driven vane 30 radially and slidably disposed in each radial slot 28. Each driven vane 30 has an outer edge 32 that engages the internal surface 72 of the housing 68. Each driven vane 30 may be biased radially outwardly by a bias member (not shown) to ensure constant contact with the internal surface 72 of the housing 68. In that regard, each outer edge 32 of each driven vane 30 of the rotor 22 slidably cooperates with the internal surface 72 of the housing 68. Likewise, each inner edge 80 of each driving vane 78 of the housing 68 slidably cooperates with the external surface 24 of the rotor 22 to permit limited relative movement between the rotor 22 and the housing 68. The rotor 22 and housing 68 define a fluid chamber 34 that is divided up into advance chambers 36 and retard chambers 38 by the circumferentially alternating driving and driven vanes 78 and 30. Therefore, the advance and retard chambers 36 and 38 are also alternately circumferentially interspersed between the rotor 22 and the housing 68. In addition, the advance and retard chambers 36 and 38 are fluid tightly separated from one another.

Figure 4:
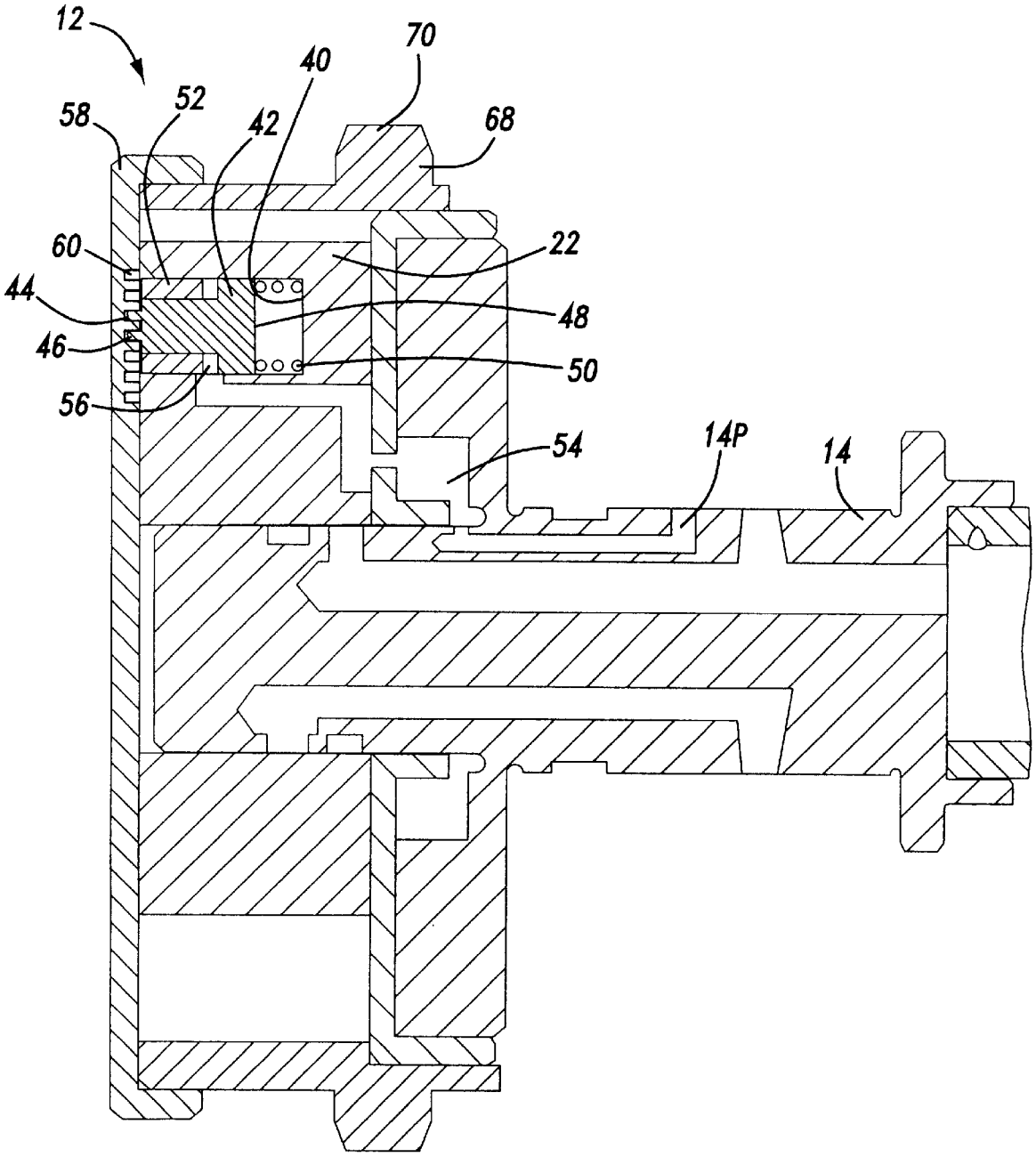
FIG. 4 is a cross-sectional view of components of the vane phaser of FIG. 2 of the preferred embodiment of the present invention and showing a locking piston engaged with a locking plate.

As shown in FIG. 4, the vane phaser 12 is in a locked condition. The axial locking piston 42 is interlocked with the locking plate 58. The axial locking piston 42 is disposed within the piston passage 40 of the rotor 22 and has an outer shank end 44 with male interlocking features such as keys 46 thereon and further has an opposite inner head end 48. The piston and piston passage are axially aligned with the female serrations 60 in a fully retarded position, a fully advanced position, and in a multitude of positions therebetween. These positions correspond accordingly with the retard serrations 62, advance serrations 64, and intermediate serrations 66 of the locking plate 58. A return spring 50 is disposed against the inner head end 48 of the piston 42 to bias the piston 42 into engagement with the locking plate 58 under a predetermined biasing force. The male keys 46 engage with the female serrations 60 of the locking plate 58. Therefore, this design relies on axial interlocking of features and not on diametral fit. Furthermore, the keys 46 and serrations 60 are designed such that there is no clearance therebetween. Accordingly, the keys 46 and serrations 60 positively interlock with one another such that there is no slack between the rotor and housing.

Figure 5:
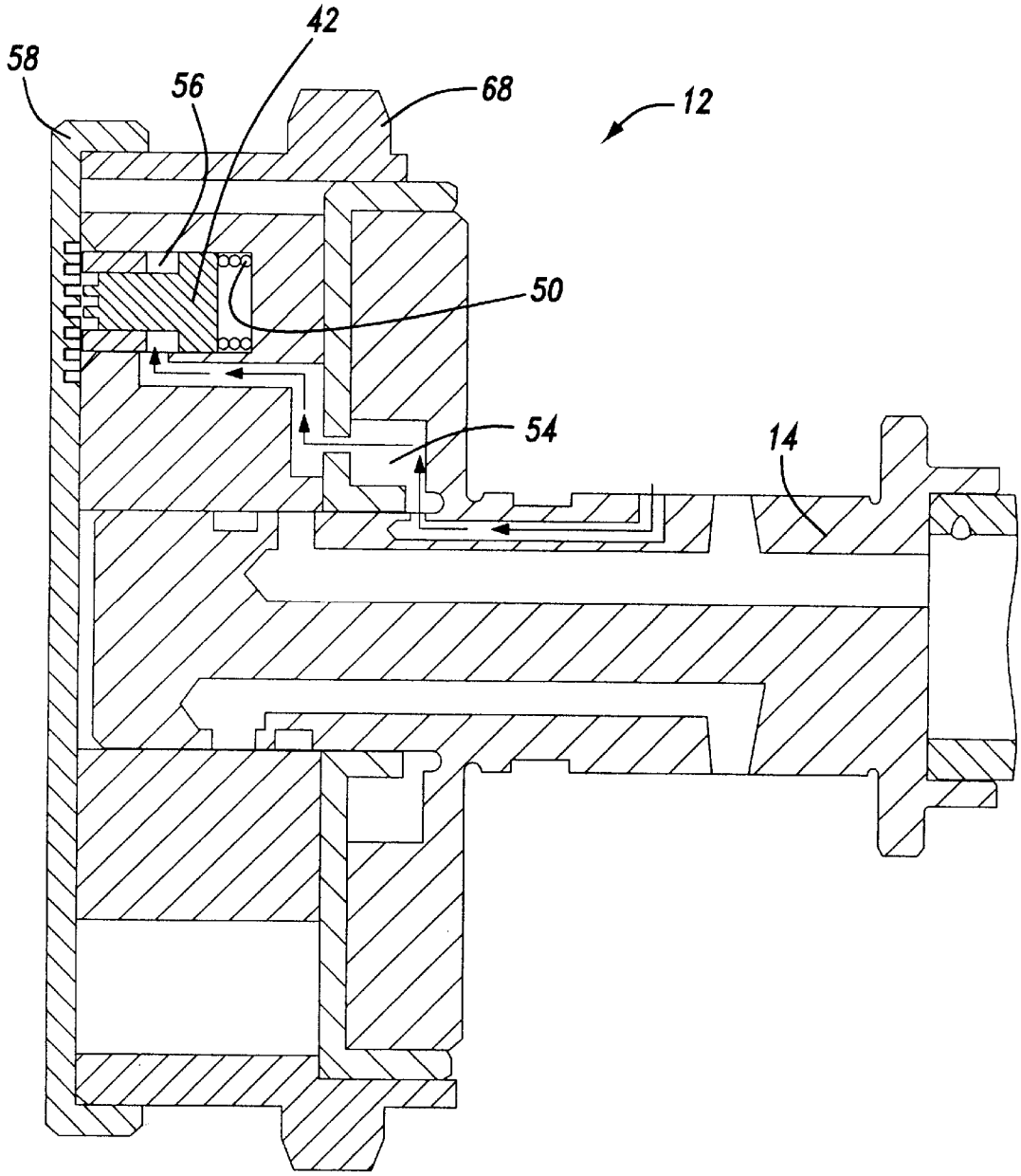
FIG. 5 is a cross-sectional view of components of the vane phaser of FIG. 4 and showing the locking piston disengaged from the locking plate

Circumscribing the outer shank end 44 of the piston 42 is a collar 52 that pilots the piston 42 in place, acts as a stop for the piston 42, and combines with the inner head end 48 of the piston 42 to define a piston chamber 56 therebetween, where oil pressure may build up to retract the piston 42. An unlocking passage 54 provides communication to the piston chamber 56 from a port 14P in the camshaft 14. FIG. 5 shows the piston 42 disengaged from the locking plate 58 and the return spring 50 fully compressed.

Figure 6:
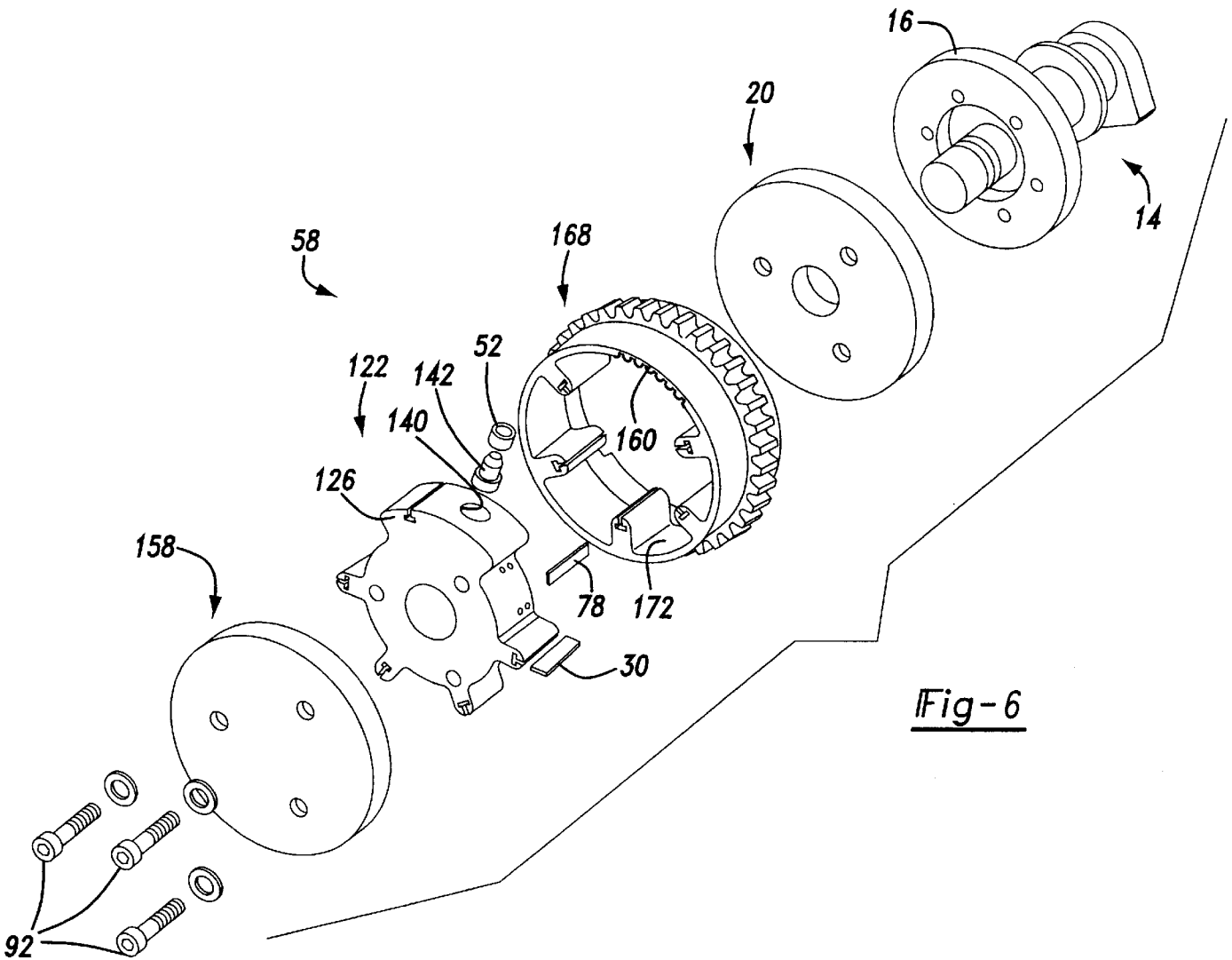
FIG. 6 is an exploded perspective view of a camshaft and vane phaser according to an alternative embodiment of the present invention.

An alternative embodiment of the present invention is shown in FIG. 6 in exploded view. The camshaft 14 has the flange 16 at one end for mounting the flange plate 20 thereto. The flange plate 20 acts as an axial locator for a housing 168, which in turn circumscribes a rotor 122. The rotor 122 and housing 168 are sandwiched against the flange plate 20 by an end plate 158. Three bolts 92 fasten the end plate 158, the rotor 122, and the flange plate 20 to the flange 16 of the camshaft 14, in turn trapping the housing 168 between the flange plate 20 and end plate 158. Accordingly, the rotor 122 and housing 168 are oscillatable independently of one another.

Figure 7:
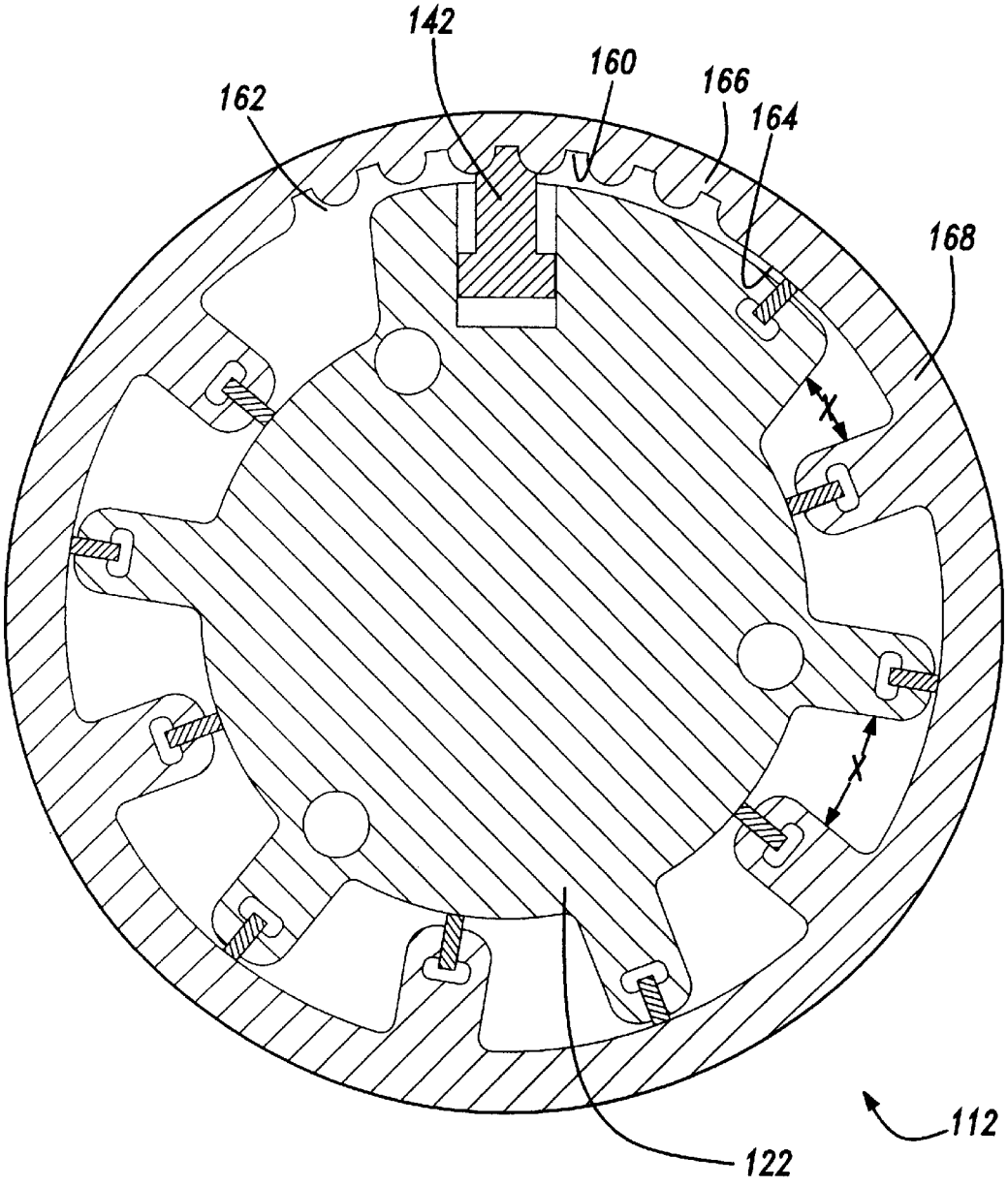
FIG. 7 is a cross-sectional left end view of the camshaft and vane phaser of FIG. 6 not including the end plate.
Figure 8:
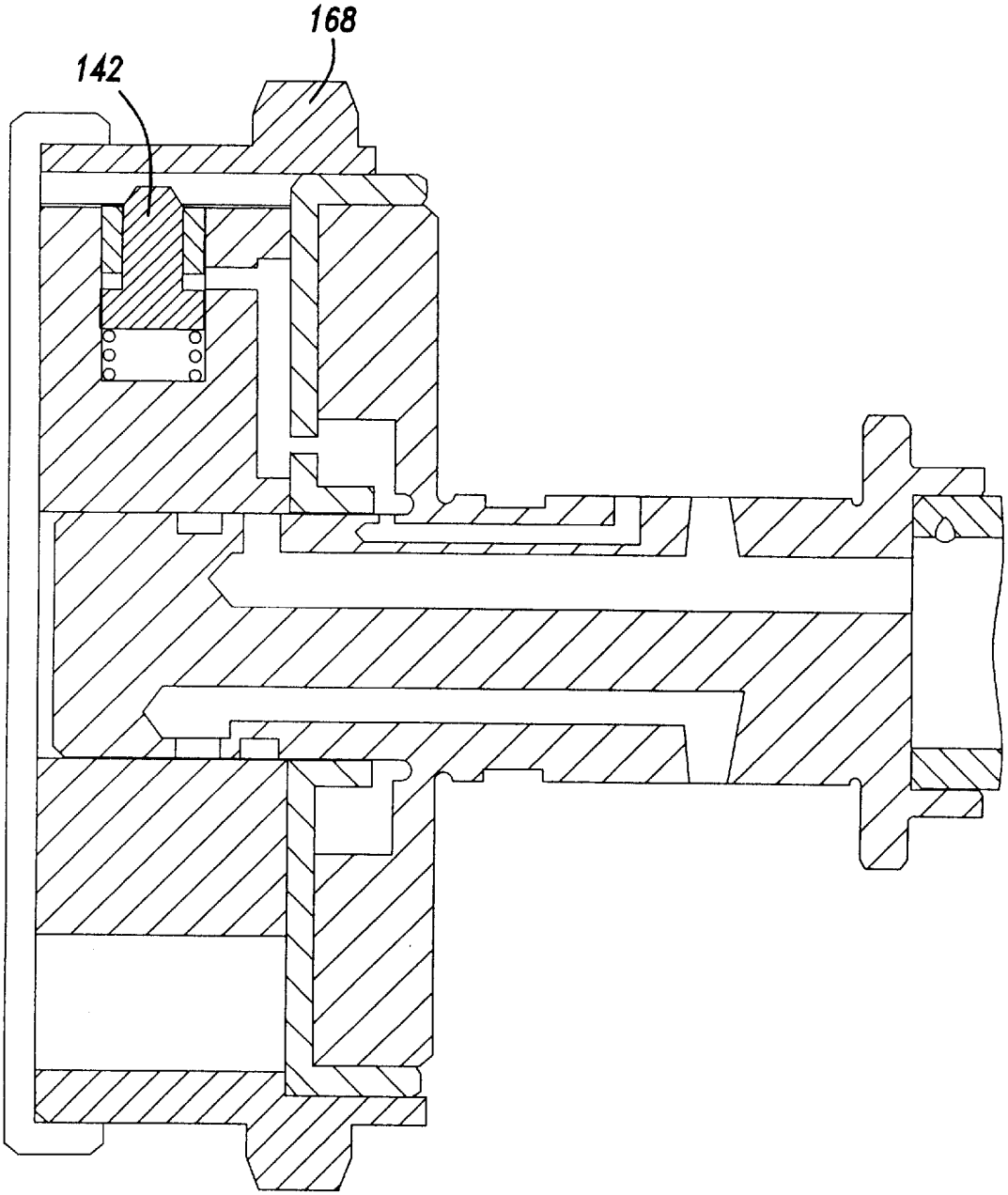
FIG. 8 is a cross-sectional view of components of the vane phaser of the embodiment of FIGS. 6 and 7 of the present invention and showing a locking piston engaged with a housing.

The rotor 122, housing 168, and driving and driven vanes 78 and 30 are the same as those of FIG. 2. Here, however, the rotor 122 includes a piston passage 140 radially disposed within one of a set of lobes 126. A generally T-shaped radial locking piston 142 and the collar 52 are likewise disposed in the piston passage 140. Additionally, the housing 168 has an array of female serrations 160 disposed in an internal surface 172 thereof for interlocking with the piston 142. As illustrated in FIG. 7 by way of a cross-sectional end view, an outer shank end 144 of the radial locking piston 142 is shown in engagement with one of the female serrations 160 of the housing 168. The array of female serrations 160 includes a retard serration 162, an advance serration 164, and a multitude of intermediate serrations 166 therebetween. Similarly, as shown in FIG. 8 in cross-sectional view, the radial locking piston 142 is engaged with the housing 168 and is similar in structure to the axial locking piston 42 of FIG. 4.

In operation, when the engine is off, the vane phaser 12 does not rotate and no engine oil pressure is present in the vane phaser 12, as shown in FIG. 4. Accordingly, the return spring 50 biases the axial locking piston 42 into engagement with the locking plate 58 to lock the vane phaser 12 in place thereby preventing any relative motion of the vane phaser components. When the engine is on, however, the assembly that includes the camshaft 14 with the rotor 22 and housing 68 is caused to rotate by torque applied to the housing 68 by an endless chain or toothed belt (not shown) that engages the sprocket teeth 70, so that motion is imparted to the endless chain by a rotating crankshaft (not shown) of the engine. The housing 68, rotates with the camshaft 14 and is oscillatable with respect to the camshaft 14 to change the phase of the camshaft 14 relative to the crankshaft.

Figure 9:
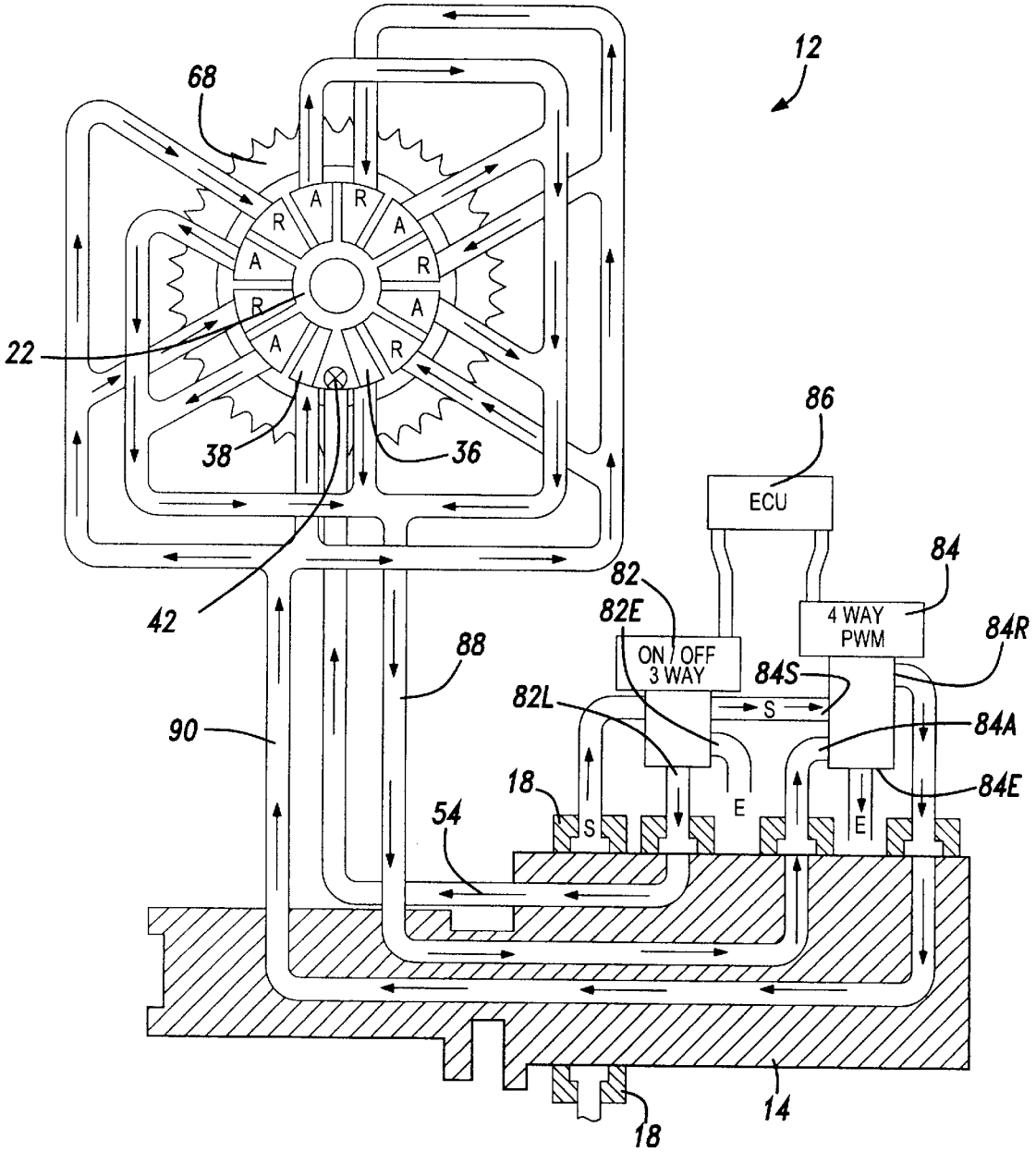
FIG. 9 is a schematic view of the hydraulic equipment of the camshaft and vane phaser arrangement according to the preferred embodiment of the present invention and illustrates a phase shift where the position of the camshaft is changing from neutral position to a retard position.

According to the preferred embodiment, and referring now to FIG. 9, the vane phaser 12 of the variable camshaft timing system is provided in schematic form. Pressurized engine oil begins to flow through a camshaft bearing 18, into a 3-way on/off control valve 82, and through the 3-way on/off control valve 82 into a 4-way pulse-width-modulated (PWM) control valve 84. An electronic engine control unit 86 processes input information from sources within the engine and elsewhere, then sends output information to various sources including the 3-way on/off control valve 82 and 4-way PWM control valve 84 to effect unlocking and phasing of the vane phaser 12.

A locking and unlocking arrangement is enabled using the pressurized engine oil flowing into the 3-way on/off control valve 82. When the 3-way on/off control valve 82 is on, it directs engine oil pressure to the unlocking passage 54 based upon output from the engine control unit 86. As shown in FIG. 5, oil pressure accumulates in the piston chamber 56 and thereby urges the axial locking piston 42 against the force of the return spring 50. This moves the piston 42 to a position where the axial locking piston 42 releases the vane phaser 12 to an unlocked condition, which then allows the vane phaser 12 to oscillate or shift phase. Consequently, the axial locking piston 42 is capable of locking the housing 68 in a fixed circumferential position relative to the camshaft 14 at a multitude of relative circumferential positions therebetween. This occurs whenever hydraulic pressure in the unlocking passage 54 falls below a predetermined value needed to overcome the force of the return spring 50. Referring again to FIG. 7, an alternative locking arrangement would include the radial locking piston 142 normally biased out of engagement with the housing 168. The vane phaser 112 would lock up in one of the circumferential positions above a predetermined rotational speed of the rotor 122. Here, the radial locking piston 142 would engage the housing 168 under a centrifugal force induced above the predetermined speed of the rotor 122.

Referring again to FIG. 9, once the vane phaser 12 is unlocked, oscillation control of the vane phaser 12 is enabled using pressurized engine oil supplied from the camshaft bearing 18 that flows through the 3-way on/off control valve 82 into the 4-way PWM control valve 84 under closed-loop control. The 4-way PWM control valve 84 is in fluid communication with an advancing fluid passage 88 and a retarding fluid passage 90 in the camshaft 14 that respectively communicate with the advance and retard chambers 36 and 38 between the rotor 22 and housing 68. The engine control unit 86 may signal the 4-way PWM control valve 84 to direct oil pressure from a supply port 84S to a retard port 84R through to the retarding fluid passage 90 and into the retard chambers 38. Simultaneously, engine oil is allowed to exhaust from the advance chambers 36 through the advancing fluid passage 88 into an advance port 84A of the 4-way PWM control valve 84 and out an exhaust port 84E. Accordingly, the rotor 22 will move toward a fully retarded position relative to the housing 68.

Alternatively, the engine control unit 86 may signal the 4-way PWM control valve 84 to direct oil from the supply port 84S to the advance port 84A through the advancing fluid passage 88 and into the advance chambers 36. Simultaneously, engine oil is allowed to exhaust from the retard chambers 38 through the retarding fluid passage 90 into the retard port 84R of the 4-way PWM control valve 84 and out the exhaust port 84E. Accordingly, the rotor 22 will move toward a fully advance position relative to the housing 68.

Additionally, the rotor 22 is capable of locking in the fully retarded position, the fully advanced position, or a multitude of positions therebetween. The rotor 22 is oscillatable with respect to the housing 68 within a range of at least 30 degrees, in at least six different circumferential positions. Once the desired phase shift has been achieved, the engine control unit 86 will signal the 3-way on/off control valve 82 to permit the oil to exhaust from the piston 42 through the unlocking passage 92 through a locking port 82L of the 3-way on/off control valve 82 and out an exhaust port 82E. Simultaneously, all engine oil flow to and from the advance and retard chambers 36 and 38 with respect to the 4-way PWM control valve 84 will cease.

Figure 10:
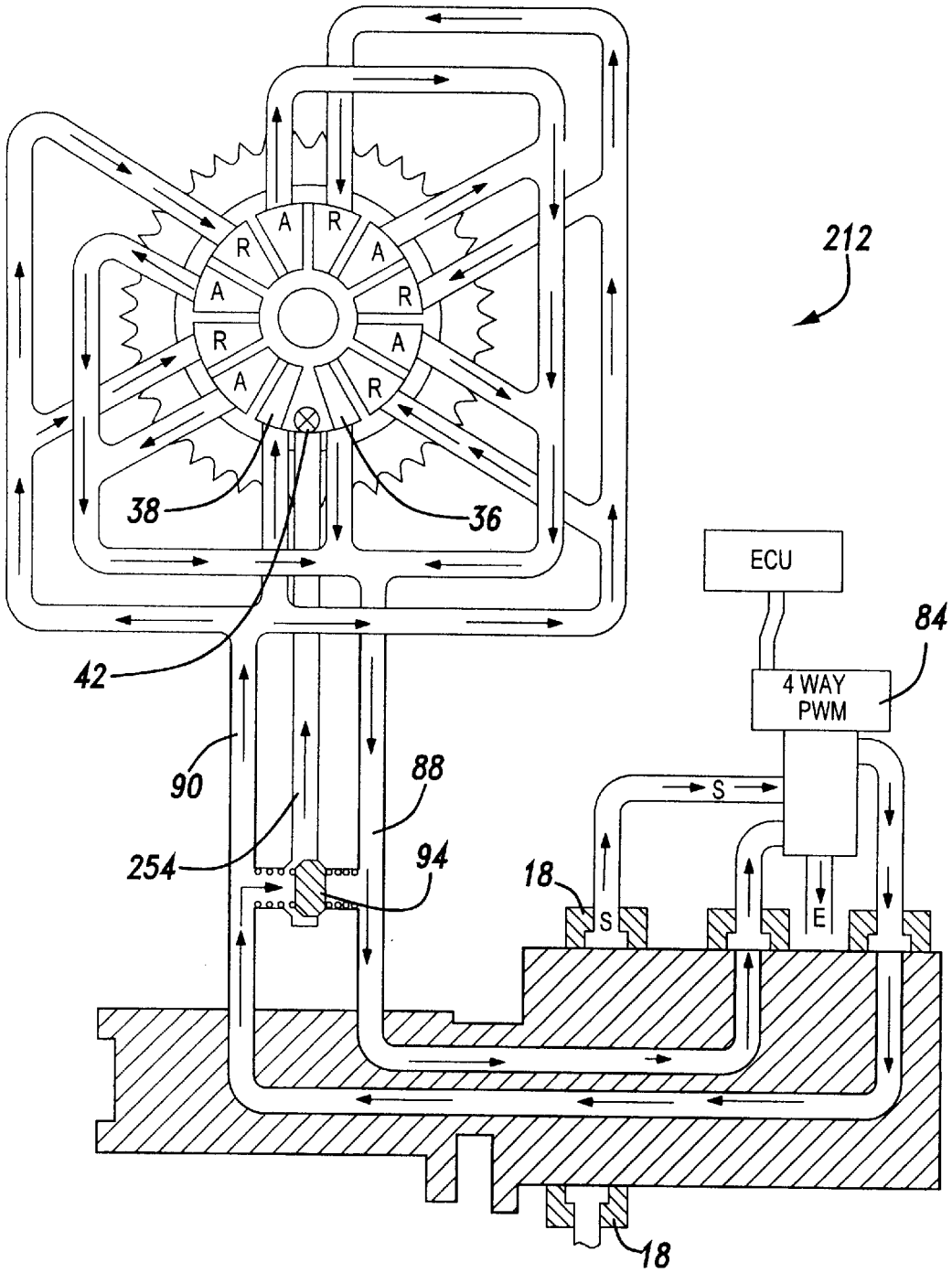
FIG. 10 is a schematic view of the hydraulic equipment of the variable camshaft timing arrangement according to an alternative embodiment of the present invention and illustrates a phase shift where the position of the camshaft is changing from neutral position to a retard position in which oil pressure flows from a retard passage to retard chambers and through a check-valve to a locking piston.

FIG. 10 illustrates an alternative vane phaser 212 of the present invention in schematic form, where locking control is effectuated by sharing oil pressure from the advance and retard passages 36 and 38 with the unlocking passage 254. Here, pressurized engine oil flows through the camshaft bearing 18 and directly into the 4-way PWM control valve 84 having a closed center. From the 4-way PWM control valve 84 oil flows through advance and retard passages 88 and 90 to the advance and retard chambers 36 and 38 as per the phaser control configuration of the preferred embodiment. Additionally, however, a check valve 94 permits engine oil to flow from the retard passage 90 to the piston 42 to retract the piston 42. Therefore, with the closed center 4-way PWM control valve 84, oil flows to the piston 42 to unlock the vane phaser 212 only when the vane phaser 212 changes phase. Alternatively, the 4-way PWM control valve 84 could have an open center to permit oil flow to the piston 42 any time the engine is in operation, thus allowing for continuous oscillation control.

Figure 11:
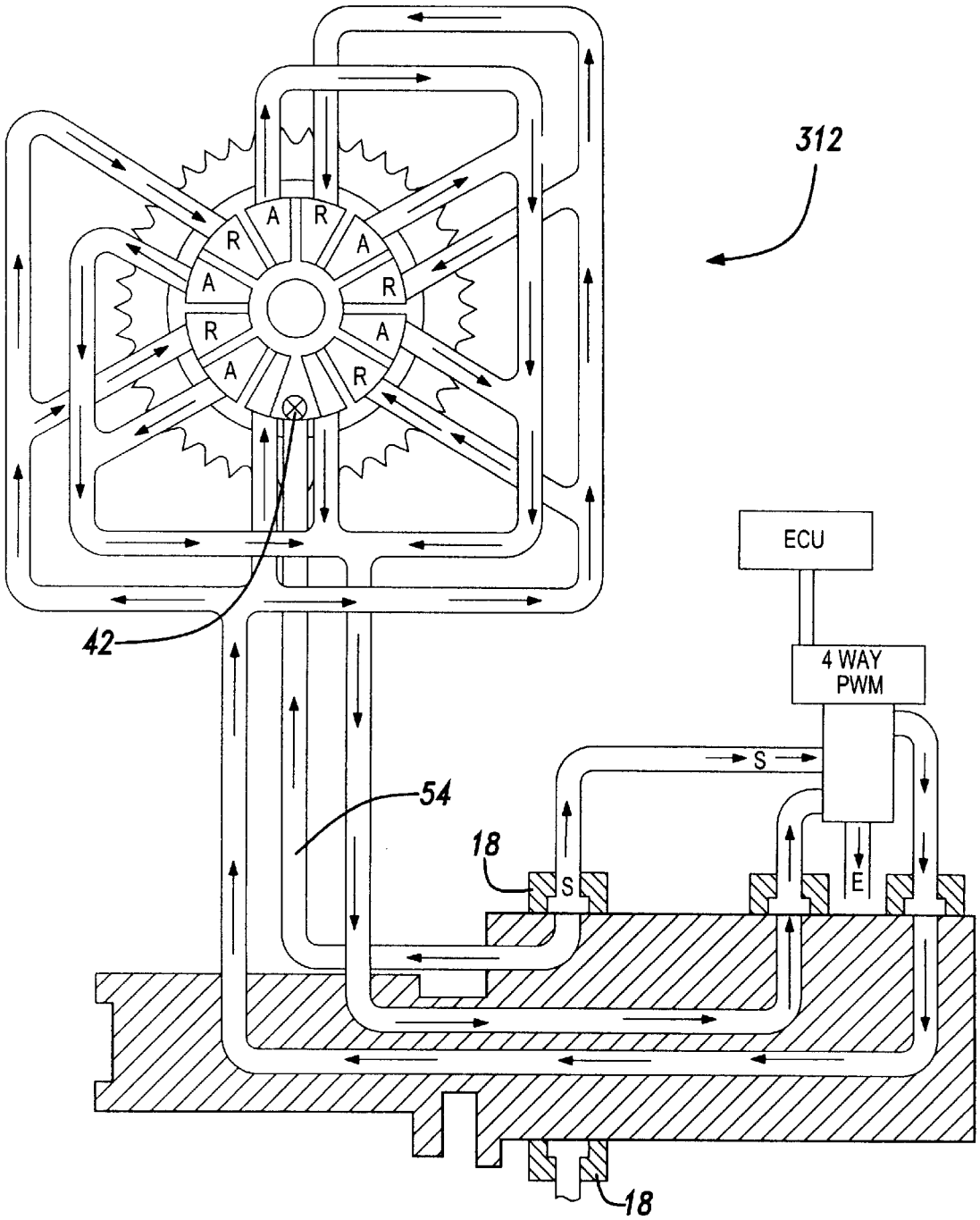
FIG. 11 is a schematic view of the hydraulic equipment of the variable camshaft timing arrangement according to another alternative embodiment of the present invention and illustrates a phase shift where the position of the camshaft is changing from neutral position to a retard position, and further illustrates oil pressure flowing directly to a locking piston to unlock the housing from the camshaft.

FIG. 11 illustrates a vane phaser 312 according to another alternative embodiment of the present invention in which the locking piston 42 is always disengaged while oil flows through the camshaft bearing 18. Here, the unlocking passage 54 communicates directly with the camshaft bearing 18 to permit engine oil to flow directly to the piston 42. In this configuration, once oil pressure is high enough to overcome the force of the return spring 50, the piston 42 will disengage (as shown in FIG. 5). Therefore, the piston 42 will be disengaged all the time that the engine is running and supplying sufficient oil pressure. Accordingly, the vane phaser 312 will be able to move to any position within the accuracy of the phaser control scheme any time during engine operation.

From the above, it can be appreciated that a significant advantage of the VCT of the present invention is that the rotor and housing are lockable relative to one another in not just one or two positions, but in an advance position, a retard position, and a multitude of positions therebetween. Additionally, only one locking piston is required to effect locking the VCT in all of the positions.

An additional advantage is that the locking piston will not jam with the component with which it interlocks, since at least the preferred embodiment of the present invention does not rely on diametral interlocking. Likewise, the present invention will not be susceptible to free play or slack conditions between the rotor and housing arising from clearance between locking members.

While the present invention has been described in terms of a preferred embodiment, it is apparent that other forms could be adopted by one skilled in the art. For example, an open-loop control strategy could be employed to achieve the phase shift of the camshaft. The variable valve timing/variable camshaft timing system of the present invention can also be controlled during operation either by an open loop system or a closed loop system, again depending on the needs or wishes of the user. In an open loop control system, there are only two control positions, either a position where the rotor moves at a fixed rate to full advance or a position where the rotor moves at the fixed rate to full retard, without any effort to modulate the rate of movement of the rotor to its full advance or full retard position, as the case may be, or to stop the movement of the rotor at any position in between such full advance and full retard positions. In a closed loop control system, on the other hand, the position of the rotor relative to the housing is monitored and the system is locked at one or another of a multitude of possible relative positions of the rotor and the housing between the full advance and full retard positions.

Likewise, alternative control valve devices may be employed to control fluid flow. Finally, female interlocking features may be placed on the locking piston rather than male interlocking features, and correspondingly male interlocking features may be mounted on the component that interlocks with the locking piston instead of female interlocking features. Additionally, the reader's attention is directed to all papers and documents filed concurrently with or previous to this specification in connection with this application and which are open to public inspection with this specification, and the contents of all such papers and documents are incorporated herein by reference. Accordingly, the scope of the present invention is to be limited only by the following claims.

The present invention, in which an exclusive property or privilege is claimed, is defined as follows:

1. An internal combustion engine comprising;

a camshaft (14);

a rotor (22) secured to said camshaft (14) for rotation therewith, said rotor (22) being non-oscillatable with respect to said camshaft (14);

a housing (68) circumscribing said rotor (22) and being rotatable with said rotor (22) and said camshaft (14) and being oscilltable with respect to said rotor (22) and said camshaft (14) between a fully retarded position and a fully advanced position;

locking means for preventing relative motion between said rotor (22) and said housing (68), said locking means mounted within said rotor (22) and releasably engageable with said housing (68) in said fully retarded position, said fully advanced position, and in at least one intermediate position therebetween; and means for controlling oscillation of said rotor (22) relative to said housing (68).

2. The internal combustion engine as claimed in claim 1, wherein said rotor is oscillatable with respect to said housing within a range of at least thirty degrees of rotation.

3. The internal combustion engine as claimed in claim 2, wherein said rotor is lockable in six different circumferential positions.

4. The internal combustion engine as claimed in claim 1, further comprising:

closed loop control means for controlling the operation of said locking means and said means for controlling.

5. The internal combustion engine as claimed in claim 1, wherein said locking means is axially moveable along the axis of rotation of said rotor (22).

6. The internal combustion engine as claimed in claim 1, wherein said locking means is radially moveable relative to the axis of rotation of said rotor (22).

7. The internal combustion engine as claimed in claim 1, wherein said locking means further comprises means responsive to engine oil pressure for disengaging said locking means to permit oscillation of said housing (68) with respect to said camshaft (14) in response to engine oil pressure when said engine is in operation.

8. The internal combustion engine as claimed in claim 7, wherein said means for disengaging comprises a passage (54) extending through said camshaft (14) for delivering a supply of engine oil pressure from said engine directly to said locking means, said supply of engine oil pressure acting against said locking means to disengage said locking means.

9. The internal combustion engine as claimed in claim 7, wherein said means for disengaging comprises a passage (54) extending through said camshaft (14) for delivering a supply of engine oil pressure from said engine and extending through said means for controlling, said supply of engine oil pressure acting against said locking means to disengage said locking means.

10. The internal combustion engine as claimed in claim 7, wherein said means for disengaging comprises:

a control valve (82); and a passage (54) extending through said camshaft for delivering a supply of engine oil pressure from said engine through said control valve (82), said supply of engine oil pressure acting against said locking means to disengage said locking means.

11. The internal combustion engine as claimed in claim 1, further comprising:

open loop control means for controlling the operation of said locking means and said means for controlling.

12. An internal combustion engine comprising:

a camshaft;

a rotor secured to said camshaft for rotation therewith, said rotor being non-oscillatable with respect to said camshaft;

a housing circumscribing said rotor and being rotatable with said rotor and said camshaft and being oscillatable with respect to said rotor and said camshaft between a fully retarded position and a fully advanced position;

a plate secured to one of said rotor and said housing;

means for controlling oscillation of said rotor relative to said housing; and locking means for preventing relative motion between said rotor and said housing, said locking means mounted within one of said rotor and said housing and respectively and releasably engageable with other of said rotor and said housing in said fully retarded position, said fully advanced position, and in at least one position therebetween, said locking means comprising:

a piston passage disposed within one of said rotor and said housing;

a locking piston slidably positioned within said piston passage, said locking piston having a male interlocking feature thereon;

an array of female interlocking features disposed in one of said plate, said housing and said rotor opposite said male interlocking feature of said locking piston, said array of female interlocking features adapted to receive said male interlocking feature to prevent oscillation of said housing with respect to said camshaft.

13. An internal combustion engine comprising:

a camshaft (14);

a rotor (22) secured to said camshaft (14) for rotation therewith, said rotor (22) having an external surface (24) thereon, said rotor (22) further having at least one outwardly extending lobe (26) thereon, said at least one outwardly extending lobe (26) having an inwardly extending radial slot (28) open to said external surface (24), said rotor (22) being non-oscillatable with respect to said camshaft (14);

a housing (68) circumscribing said rotor (22), said housing (68) having an internal surface (72) thereon, said housing (68) further having at least one inwardly extending lobe (74) thereon, said at least one inwardly extending lobe (74) having an outwardly extending radial slot (76) open to said internal surface (72), said housing (68) being rotatable with said rotor (72) and said camshaft (14) and being oscillatable with respect to said rotor (22) and said camshaft (14) between a fully retarded position and a fully advanced position, said housing (68) and said rotor (22) defining a fluid chamber (34) therebetween;

a driving vane (78) radially and slidably moveable in said outwardly extending radial slot (76) of said housing (68), said driving vane (78) having an inner edge (80) engaging said external surface (24) of said rotor (22), said driving vane (78) being spring-loaded radially inwardly to ensure constant contact with said external surface (24) of said rotor (22);

a driven vane (30) radially and slidably disposed in said inwardly extending radial slot (28) of said rotor (22), said driven vane (30) having an outer edge (32) engaging said internal surface (72) of said housing (68), said driven vane (30) being spring-loaded radially outwardly to ensure constant contact with said internal surface (72) of said housing (68);

said driving and driven vanes (78 and 30) defining at least one advance chamber (36) and at least one retard chamber (38) alternatively interspersed within said fluid chamber (34), said advance and retard chambers (36/38) being fluid tightly separated from each other;

a locking plate (58) secured to one of said rotor (22) and said housing (68);

locking means for preventing relative motion between said rotor (22) and said housing (68), said locking means mounted within one of said rotor (22) and said housing (68) and respectively and releasably engageable with either of said rotor (22) and said housing (68) in said fully retarded position, said fully advanced position, and in at least one circumferential position therebetween, said locking means being reactive to said engine oil pressure, said locking means comprising:

a piston passage disposed in said rotor;

a locking piston (42) slidably positioned within said piston passage (40), said locking piston (42) having an inner end (48) thereon and an outer end (44) oppositely disposed said inner end (48), said locking piston (42) having male keys (46) on said outer end (44);

female serrations (60) disposed in one of said plate (58) and said housing (68), said female serrations (60) being aligned with said piston passage (40) in said fully retarded position, in said fully advanced position, and in at least one intermediate position of said rotor (22) with respect to said housing (68) and being adapted to receive said male keys (46) of said locking piston (42) in said fully retarded, in said fully advanced, and in said at least one intermediate position to prevent oscillation of said housing (68) with respect to said camshaft (14);

a collar (52) circumscribing a portion of said locking piston (42) to support and locate said locking piston;

means for engaging said locking piston (42) into engagement with one of said plate (58) and said housing (68) under a predetermined biasing force when said engine is out of operation, said means for engaging resiliently acting on said inner end (48) of said locking piston (42) to urge said outer end (44) of said locking piston (42) outwardly from said piston passage (40); and means for disengaging said locking piston (42) from one of said plate (58) and said housing (68), said means for engaging comprising said piston passage (40) being adapted to receive engine oil pressure from said means for controlling, said means for engaging further comprising engine oil being under pressure and being capable of overcoming said biasing force of said biasing means to slide said locking piston (42) in a direction opposite of said female serrations (60) to release engagement between said locking piston (42) and said female serrations (60) and maintain said locking piston (42) out of engagement with said female serrations (60) to permit oscillation of said housing (68) with respect to said camshaft (14) in response to engine oil pressure when said engine is in operation; and means for controlling oscillation of said rotor (22) relative to said housing (68), said means for controlling comprises:

means for porting said advance chamber (36); and means for porting said retard chamber (38); said means for controlling being capable of supplying said advance and retard chambers (36/38) with engine oil pressure or exhausting said advance and retard chambers (36/38) of engine oil pressure to relatively displace said driving and driven vanes (78/30).

14. The internal combustion engine as claimed in claim 13, wherein said means for disengaging comprises:

a passage extending through said camshaft for delivering a supply of engine oil pressure from said engine directly to said locking means, said supply of engine oil acting against said locking means to disengage said locking means.

15. The internal combustion engine as claimed in claim 13, wherein said means for disengaging comprises:

a control valve; and a passage extending through said camshaft for delivering a supply of engine oil pressure from said engine through said control valve, said supply of engine oil pressure acting against said locking means to disengage said locking means.

16. The internal combustion engine as claimed in claim 13, wherein said means for disengaging comprises a passage extending through said camshaft for delivering a supply of engine oil pressure from said engine through said means for controlling, said supply of engine oil pressure acting against said locking means to disengage said locking means.

17. The internal combustion engine as claimed in claim 16, wherein said means for controlling further comprises a four-way control valve communicating with said advance and retard chambers, and said passage communicates with one of said advance and retard chambers to disengage said locking means when said means for controlling is actuated.

18. The internal combustion engine as claimed in claim 17, wherein said four-way control valve has an open center to permit oil pressure to said locking means any time said engine is in operation.

19. The internal combustion engine as claimed in claim 17, wherein said four-way control valve has a closed center to permit oil pressure to said locking means only when said means for controlling is actuated to change phase of said rotor.

* * * * *